United States Patent [19]

Gautier

[11] 4,216,639

[45] Aug. 12, 1980

[54] PROCESS OF MAKING CONTAINERS MADE OF THIN PLIABLE SYNTHETIC MATERIAL

[75] Inventor: Raoul L. A. Gautier, Vittel, France

[73] Assignee: Societe Generale des Eaux Minerales de Vittel, Vittel, France

[21] Appl. No.: 11,066

[22] Filed: Feb. 12, 1979

[30] Foreign Application Priority Data

Feb. 15, 1978 [FR] France ..... 78 04233

[51] Int. Cl.[2] ..... B65B 61/14; B65B 43/04

[52] U.S. Cl. ..... 53/413; 53/455

[58] Field of Search ..... 229/53, 54 R, 56; 53/413, 450, 455, 459, 550, 562, 568, 134; 93/35 PC; 150/12; 206/213.1

[56] References Cited

U.S. PATENT DOCUMENTS

| | | | |
|---|---|---|---|
| 2,194,451 | 3/1940 | Soubier | 53/450 |
| 2,245,738 | 6/1941 | Taylor | 229/56 |
| 2,247,312 | 6/1941 | Rumsey, Jr. | 93/35 PC |
| 2,718,105 | 9/1955 | Ferguson | 53/450 |
| 2,928,216 | 3/1960 | Orsini | 53/434 |
| 3,319,538 | 5/1967 | Bodolay | 53/455 |
| 3,670,927 | 6/1972 | Hobbard | 229/56 |

*Primary Examiner*—John Sipos

*Attorney, Agent, or Firm*—Christel, Bean & Linihan

[57] ABSTRACT

A container made of synthetic material and comprising two compartments, one containing the liquid or other matter the container is to carry, and one, of smaller volume, containing a gas under pressure. The smaller pressurized container rigidifies the structure and may be shaped in such a way as to form a handle or grip for the container. A process and apparatus for manufacturing and filling rows of such containers is also disclosed, said process involving forming a strip of synthetic material into the shape of a letter W in transverse section and performing various welding operations on the strip to form individual containers and to divide off the two compartments.

11 Claims, 10 Drawing Figures

(N+1)L
25B
22B
22A
25A
16B
24B
24A
13B
13A
12A
10A
9
11
17
18A
26
20
20a
20b
19A
19B
21A
21B
A
B
C
D
F
f
h
1
1a
1b
2a
2b
3a
3b
3c
3d
4A
4B
7a
7b
8

PROCESS OF MAKING CONTAINERS MADE OF THIN PLIABLE SYNTHETIC MATERIAL

The present invention relates to a container made of thin pliable synthetic material, and to a process of manufacturing it.

French Pat. No. 75.18358, filed by the present applicant on 12th June, 1975, describes a container made of thin pliable synthetic material comprising, in addition to its main cavity, at least one closed pocket filled with a fluid and not communicating with said main cavity, this pocket and the fluid with which it is filled being such as to impart a degree of rigidity to the container, particulary when emptying its main cavity. In particular, the closed pocket may be so arranged as to form a handle or grip for the container. In a particular form of the container described in the above-mentioned French Patent, its closed pocket and its main cavity, likewise closed, contain the same liquid, for example mineral water.

A first object of the present invention is to improve on the container described in the above-mentioned French Patent.

A second object of the present invention is to provide a container made of thin pliable synthetic material and comprising a main cavity, at least one closed pocket which contains A fluid imparting a degree of rigidity to the container and which may be used as a handle or grip, said closed pocket being filled with a gas under pressure.

It will thus be seen that the invention makes it possible to avoid filling the closed pocket, acting as a handle or grip for example, with the same liquid as that put into the main cavity. It has been found that users have shown some reluctance to make use of the liquid contained in the handle or grip of the container, doubtless because they were not sure that it was precisely the same drinkable liquid as that contained in the main cavity.

Another object of the present invention is to provide a container comprising at least two side walls and a bottom consisting of at least one sheet of thin pliable composite synthetic material heat weldable only on the faces presented to the interior of the container. It is known that there exist composite synthetic materials of this kind which offer considerable resistance to permeation by atmospheric gases, and this is very advantageous in the preservation of beverages. In this embodiment of the container of the present invention its bottom has two V-shaped folds which extend parallel to the two side walls over their entire length, the ends of each of these two V-shaped folds being closed by welds but being separate from each other at least between their welded ends.

These containers made in accordance with the present invention can be provided in two different forms which are particularly advantageous in that they can greatly facilitate the rapid and completely automatized manufacture of a large number of identical containers in rows.

In the first form of construction mentioned above, the ends of the two V-shaped folds at the bottom, corresponding to the bottom corners of the container are cut off and welded to form bevelled corners in such a way that the two folds are separate from each other over their entire length. When the main cavity of such a container is filled with liquid, the weight of the latter has the effect of substantially flattening out the two V-shaped folds at its bottom, at least in the median portion of the bottom, and this results in a large and practically, flat standing surface of the filled container.

In the second form of construction mentioned above, the two V-shaped folds at the bottom are connected to each other by adhesive bonding only at their corresponding welded ends. In this case, the filled container can be stood by the lower portions of the V-shaped folds at its bottom and by their welded and bonded ends.

Particularly in the case of this second form of construction and in accordance with a further embodiment of the invention, the container can be stood in a still more stable manner if the bottom of each of the two V-shaped folds is stiffened by a weld extending along the entire length of the corresponding fold.

The present invention is also concerned with rows of interconnected identical containers of the type defined above. According to a preferred embodiment of the present invention, the containers of such rows are connected together along the welded edges of their side walls by a narrow joint consisting of a frangible or cuttable synthetic material, at least one of the end recipients of the row being similarly connected to a substantially rigid end handle.

Such rows, comprising for example from two to ten closed containers each accommodating the same liquid and provided with a handle, at one end only in the case of a row of two or three containers, or at each end, in the case of a larger number of containers, are particularly convenient in the marketing of beverages such as mineral water. In this latter case in particular, it is especially advantageous to provide rows of six to ten containers each filled with a liter of mineral water and each row being provided with a handle at each of its two ends so that it can be carried in one hand, said row being bent round so that the two handles at its ends coincide with each other.

In a preferred form of the row of containers each end handle comprises one or more closed pockets of pliable synthetic material containing at least one rigid plate or a pressurized gas, for example slightly compressed air. Preferably, all the containers and the end handle or handles of the rows are formed by a single strip of pliable synthetic material, folded to the shape of a letter W, which strip is cut to the required length, welded and, optionally, adhesive bonded. This arrangement is particularly advantageous in that it enables a large number of rows of containers in accordance with the present invention to be manufactured continuously, automatically and rapidly.

In accordance with a second aspect of the invention, there is provided a process for the continuous manufacture of containers of the above-indicated types, said process comprising the steps of advancing horizontally and in a stepwise manner, a strip of composite synthetic material, folded longitudinally to the shape of a letter W, each feed step being a little greater than the width of each container or than a multiple of its width and, for the production of each container, simultaneously welding the bottoms of the two V-shaped folds in the strip, making a first and second weld transversely of the strip and separated by a distance corresponding to the required width or each container, and interconnecting the inner faces of the folded strip and of its two V-shaped folds; making a third weld, delimiting, together with the first weld, the main cavity in the container and, together with the second weld, the pocket of the container, said cavity and pocket remaining open at the upper edges of the folded strip; separating the upper edges of the strip at least at the main cavity so as to introduce a liquid into the main cavity and to introduce means for injecting gas under pressure into the pocket; pressing the upper edges of the folded strip against each other and around said means during injection of gas under pressure; then, after retraction of said means, welding the upper edges of the folded strip to each other to close the main cavity and the pocket.

In order that the invention may be better understood, several embodiments thereof will now be described by way of example only and with reference to the accompanying drawings in which.

Figures 1, 2, 3, 4, 5, 6, 7:
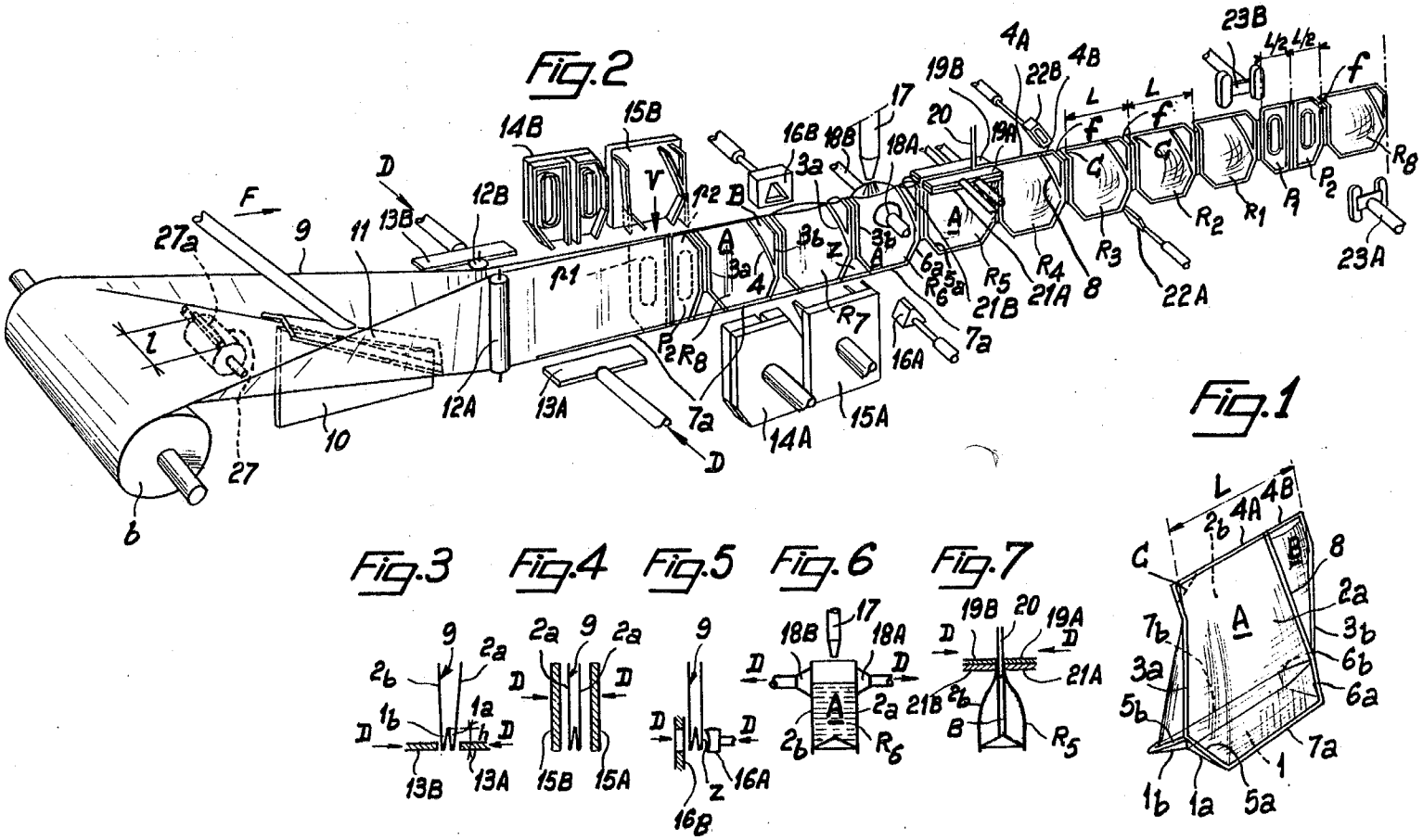
FIG. 1 is a diagrammatic perspective view of a first embodiment of container in accordance with the present invention and made of thin pliable synthetic material and containing mineral water.
FIG. 2 is a diagrammatic perspective view of a process for the continuous and automatic production of rows of containers as illustrated in FIG. 1.
FIGS. 3 to 7 show various details of the process of FIG. 2 in cross-section.

Referring to FIG. 1, the container comprises a main cavity A, and a closed pocket B, filled with a fluid and not communicating with the main cavity. The pocket B and the fluid contained therein are so selected as to impart a degree of rigidity to the container particularly when emptying the main cavity A, this being done for example, after making a cut through its pouring spout along the broken line C. The main cavity A is filled with mineral water, whereas the closed pocket B is filled with a pressurized gas, for example slightly compressed air.

The container has a bottom 1 and two side walls 2*a* and 2*b* which are preferably formed by a single thin sheet of pliable synthetic material welded along its juxtaposed edges 3*a* and 3*b*. The closed pocket B is separated from the main cavity A by a continuous weld line 8 interconnecting two juxtaposed zones of the side walls 2*a* and 2*b*. The bottom 1 and the two side walls 2*a* and 2*b* are made of a composite synthetic material of a known type which can be heat-welded only on the faces presented to the interior of the container, and the bottom 1 has two V-shaped folds 1*a*and 1*b* which extend parallel to the two lateral walls 2*a* and 2*b* over their entire length, the end of each of these two V-shaped folds being closed by welds 5*a*, 5*b* in the one case, and by welds 6*a*, 6*b* in the other; however, the two V-shaped welds 1*a* and 1*b* at the bottom 1 are separate from each other and their ends are cut off and bevel-welded, as can be clearly seen at 5*a* in FIG 1. Finally, the lower edge of each of the two V-shaped folds 1*a* and 1*b* of the bottom 1 is stiffened by welds 7*a* and 7*b* respectively extending over the entire length of the folds 1*a* and 1*b*.

The weight of the liquid contained in the main cavity A has the effect of substantially flattening the inner faces of the two V-shaped folds 1*a* and 1*b* of the the bottom 1 except, obviously, near the welded ends of the folds, but this nevertheless results in a standing surface great enough to ensure good stability of the container, the bottom 1 of which is placed on a horizontal surface. The closed pocket B forms a handle enabling the container to be easily held; it could also take any one of numerous other forms, or it could even be cut and shaped to form a bowed handle.

FIG. 2 illustrates diagrammatically and in perspective means for carrying out the process in accordance with the present invention for producing, in a continuous and automatic manner, rows of containers identical to that of FIG. 1. In particular FIG. 2 shows the various successive stages in the manufacture of a row of eight contiguous containers R1 to R8, each closed and filled with mineral water, these containers being connected along welded edges of their side walls by a narrow joint consisting of frangible or cuttable synthetic material, and the two end containers R1 and R8 of the row being provided in the same way with substantially rigid end handles P1 and P2. In the arrangement in question, each of the end handles P1 and P2 has, in the longitudinal direction of the row, a length which is half the length L of each of the containers (see FIGS. 1 and 2).

The process illustrated in FIGS. 2 to 7 is carried out in the following manner:

Known means, which do not require to be described in detail, are provided for feeding horizontally and incrementally in the direction of the arrow F (FIG. 2) a strip 9 of a composite synthetic material, heat-weldable only on its upper face, this strip being dispensed from a supply roll b arranged with its axis horizontal; various thin pliable synthetic materials of this kind are known which are preferred for use in the preservation of substances and particularly beverages such as mineral water since they comprise a heat-weldable layer which does not react with food substances and may thus be brought into contact with the latter. These materials also comprise a layer which is not heat-weldable and which resists, to a large extend, permeation, particularly by atmospheric gases.

Known means comprising in particular suitably supported guide plates such as those shown at 10 and 11 and two guide rollers 12A and 12B, arranged with their axes vertical, are provided for folding the strip 9 into the form of a letter W as it is paid out from the feed roll b. In the cross-sectional view of FIG. 3 are shown the portions of the strip 9 which are intended to form the side walls 2*a* and 2*b* of each of the containers R1 to R8 forming the row. FIG. 3 also shows the two V-shaped folds 1*a* and 1*b* at its bottom (refer also to FIG. 1).

With each of the incremental feed steps having a length slightly greater than the length L of each of the containers R1 to R8, the bottoms of the two V-shaped folds 1*a* and 1*b*, formed in the strip 9 pass between two electrodes 13A and 13B (see also FIG. 3) which, during each time interval between two successive feed steps, are moved towards each other in a transverse direction D so as to weld the bottoms of the two V-shaped folds 1*a* and 1*b*. These two folds, however, remain separate from each other—at their welded bottoms as well—because the latter, due to the advance of the welding electrodes 13*a* and 13*b* are applied to each other by way of the non-weldable face portions of the strip 9 (i.e. its inner face when seen in FIG. 3).

Rigid pre-cut plates p1 and p2, made of cardboard, for example, are then introduced simultaneously in juxtaposed relationship between the two portions 2*a* and 2*b* of the strip 9, folded to the shape of a letter W, to form rigid elements for the end handles P1 and P2 of two consecutive containers. This operation can take place simultaneously with the welding of the peripheries of the handles P1 and P2 (see below) during the time interval between two successive feed steps of the strip, since any two contiguous handles P1 and P2 will occupy the same length L of the strip 9 as each of the containers R1 to R8. The simultaneous welding operation on the peripheries of two contiguous end handles P1 and P2 are carried out by advancing, in the transverse direction D, two welding and cutting tools 14A and 14B of suitable shape towards each other.

Upon the next incremental stoppage of the strip 9 the movement, in the transverse direction D, of two welding electrodes 15A and 15B of appropriate shape (see also FIG. 4) makes is possible to form simultaneously a first and second weld transversely of the strip 9 and separated by a distance corresponding to the width L of each of the containers R1 to R8, which welds interconnect the inner faces of the lateral walls 2*a* and 2*b* (FIG. 4) of the folded strip and of its two V-shaped folds 1*a* and 1*b*, and, at the same time, a third weld 8 which, together with the first weld, delimits the main cavity A of the container and, together with the second weld, delimits the pocket B of the container. This operation therefore enables the welded joints 3*a*, 3*b* and 8 of the container illustrated in FIG. 1 to be formed simultaneously. The cavity A and the pocket B of course then remain open at the upper adjacent edges of the strip. Furthermore, each first welded joint 3*a* and each second welded joint 3*b* is so formed as to provide a bevelled connection between the inner faces of the two V-shaped folds 1*a* and 1*b* of the strip 9. In this way a substantially trapezoidal zone Z is formed between two consecutive containers, which zone is bounded at the top in the two V-shaped folds 1*a* and 1*b* in the strip 9 by the adjacent bevel-welded portions 3*a* and 3*b* corresponding to two containers formed one after the other, for example the containers R6 and R7. With the next incremental stoppage of the strip, this substantially trapezoidal zone Z is cut away by a punch 16A and a die 16B which are moved towards each other in the transverse direction D (see also FIG. 5).

The container that is being formed in the strip 9, still folded in the shape of a W, for example the container R6 of a row that is being formed, then stops below a spout 17 for supplying the beverage, for example mineral water, intended to be charged into the main cavity A of the container. The upper edges of the container in question, for example the container R6, are then separated at said main cavity A by any suitable means, for example, with the aid of two suction pads 18A and 18B (see also FIG. 6), which are displaceably mounted so that they can be moved away from each other in the transverse direction D, this then enabling the beverage, supplied through the spout 17, to flow into the main cavity A of the container R6. When its main cavity A is filled with the required amount of mineral water, the flow of liquid through the spout 17 is stopped and the action of the suction pads 18A and 18B is interrupted.

The next incremental step in the movement of the strip 9 then brings its upper edges, released by the suction pads, between two jaws 19A and 19B each of which has a width substantially equal to the length L of each container and which are made of or at least lined with a resilient substance such as rubber. A small pipe 20 for injecting compressed air is then moved down into the pocket D of the container, the upper edges of which container are still free, after which the jaws 19A and 19B are brought towards each other in the transverse direction D (see also FIG. 7), and are applied against each other under a predetermined pressure so as to close temporarily the cavities A and B of the container. The pipe 20 then introduces compressed air into the pocket B, after which it is extracted from the said pocket B by an upward vertical movement in the direction of the arrow B. Because of the resilience of the edges of the jaws 19A and 19B, the compressed air previously introduced into the pocket B remains trapped therein. The upper edges of the walls 2*a* and 2*b* of the container are then immediately welded just below the jaws 19A and 19B, and are held in the gripped position by moving, in the transverse direction D, two electrodes 21A and 21B having a length substantially equal to L so that the upper weld 4A–4B of the container is formed (see also FIG. 1).

Upon the next incremental stoppage of the strip 9 , a narrow notch f is formed between the spout C of a finished container, such as the container R3, and the upper portion of the adjacent container, such as the container R4, or the contiguous handle (see notch f formed between the container R8 and the handle P2 at the right-hand side of FIG. 2). The notch f is formed by moving a blade 22A and a die 22B towards each other in the transverse direction D.

Finally, there is provided a last station, not illustrated, where a shear separates the contiguous end handles P1 and P2 of a first row (the last container R8 of which is only visible at the extreme right in FIG. 2) and of a second row immediately following the first row. Thus, rows of, for example, eight closed containers, each filled with one liter of mineral water for example, are obtained in an automatic and very rapid manner. Each of these rows can be carried in a particularly simple manner by bringing together its two end handles P1 and P2 so as to enable the hand to be inserted into their central openings, brought into register with each other.

The containers may now be separated from one another by means of a pair of scissors by cutting through the narrow joints, made of thin synthetic material which connect, for example, the container R1 to the handle P1 and to the container R2 respectively. After having been separated from the remainder of the containers in the row, the container R1 may be placed by its substantially flat bottom on a table for example. Opening of the container involves no more than cutting through its pouring lip along the line C (FIG. 1). Picking up of the container for the purpose of pouring out its contents is facilitated by the presence of the inflated handle B which furthermore imparts to the container as a whole a residual rigidity as said container is emptied. Thanks to this residual rigidity obtained by means of the inflated handle B, it is, in particular, possible to pour out a portion of the contents of the cavity A of the container while still being able to then place the partially emptied container on a flat surface without the risk of collapse of the container.

The process or method of manufacture described above can be modified in numerous ways. The number and capacity of the containers in each row as well as the nature of the liquid that they contain are matters of choice. In the case of containers of smaller capacity or of rows comprising only two or three containers, a single end handle can be provided. The same means and a similar method can be used for manufacturing not only rows of identical containers, each provided with at least one end handle, but for producing on a continuous and automatic basis identical containers which are separated from each other at the outlet station by the above-mentioned shear.

The same means may of course also permit the manufacture of rows of empty containers or of single empty containers, having upper edges to the main cavity A that are not welded up, the closed pocket B however, being inflated. Such containers or sachets can be put to a great number of different uses and may serve in particular for preserving various substances.

Instead of being reinforced by a rigid plate, each of the end handles P1 and P2 of the various rows of containers could be filled with a compressed gas, for example slightly compressed air. In the case of the process illustrated in FIG. 2, this could be achieved for example, when the corresponding portion of the strip 9, folded to the shape of a letter W, stops below the pipe 20 for injecting compressed air; since, in this case, the electrodes 14A and 14B are so shaped as to form in the strip 9, two communicating pockets open at the upper edges of the strip 9, it would then suffice to introduce the air-injection pipe 20 into the opening of said communicating pocket, to bring the upper edges of the folded strip 9 together and around the pipe with the aid of the resilient jaws 19A and 19B, during the introduction of compressed air and then, after retracting the injection pipe 20, to close the upper edges of the two pockets by welding with the aid of the two electrodes 21A and 21B, as well as to close them off from each other with the aid of two additional electrodes which can be moved towards each other in the transverse direction D. The welding up of the bottoms of the two V-shaped folds of the folded strip 9 with the aid of electrodes 13A and 13B is optional; however, the welds so formed (7*a* and 7*b* in FIG. 1) contribute to the stability of the filled recipient when it is placed on a flat surface.

Figures 8A, 8B, 9:
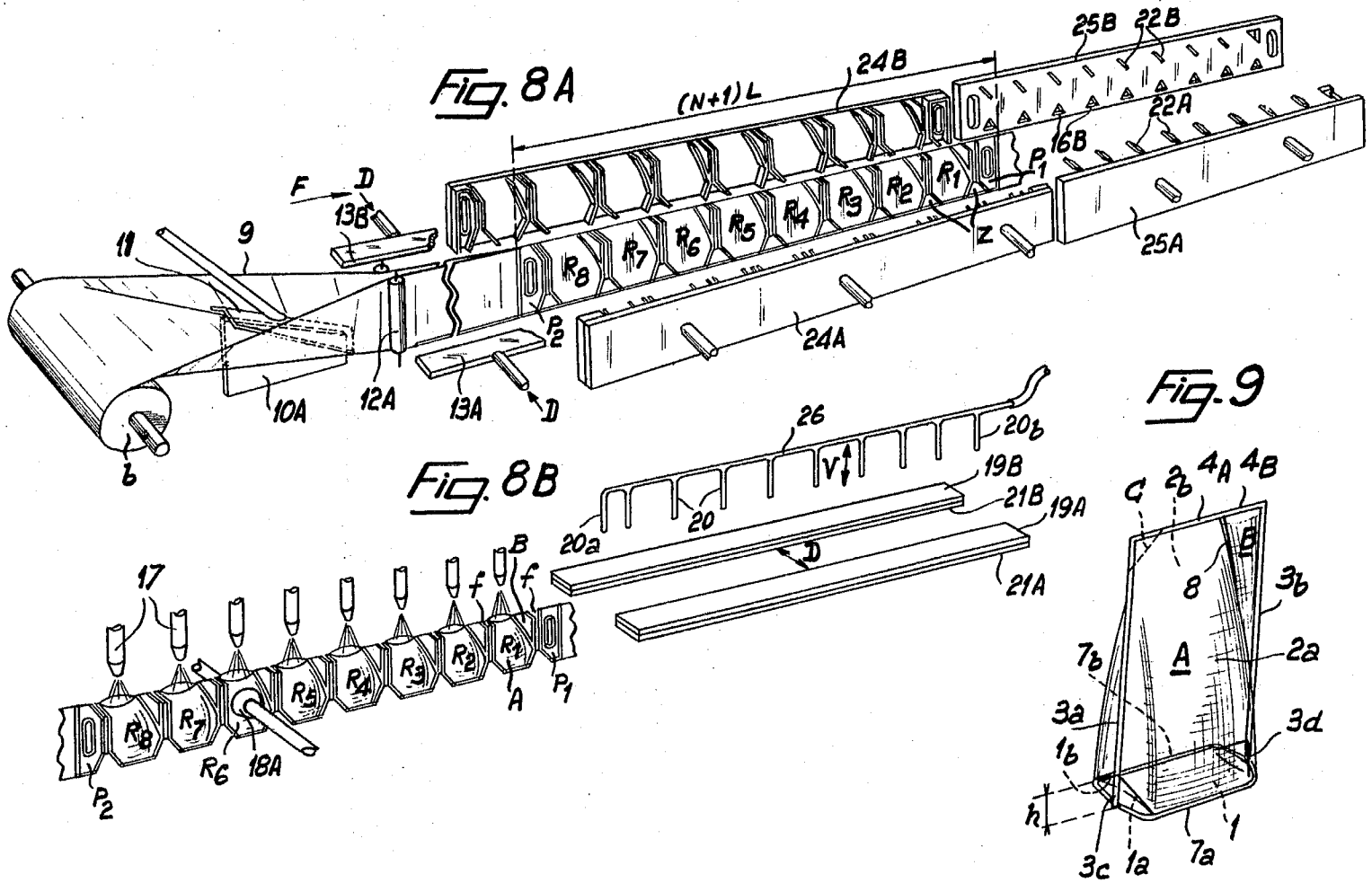
FIGS. 8A and 8B are diagrammatic perspective views of two consecutive portions of a modified form of the process of FIG. 2.
FIG. 9 illustrates diagrammatically and in perspective a second embodiment of container in accordance with the present invention, made of a thin pliable synthetic material and containing mineral water.

FIGS. 8A and 8B illustrate two consecutive portions of a modified form of the process illustrated in FIG. 2 and previously described. The same reference numerals and letters have been used for indicating, in FIGS. 8A to 8B, elements corresponding to certain of the elements illustrated in FIG. 2. In this modified form, the strip 9, folded to the shape of a letter W by the means previously described, is advanced in a stepwise manner in the horizontal direction F, each feed step being a little greater than (N+1) L which is the total length of a row of N identical containers provided with two end handles, each having a length of L/2. Each of the electrodes 13A and 13B, 24A, 24B, 21A, 21B, each of the cutting tools 25A and 25B and each of the resilient jaws 19A, 19B have a length substantially equal to a feed step of the strip 9, that is to say, a little greater than (N+1) L.

The electrodes 13A and 13B serve to weld simultaneously the bottoms of the V-shaped folds (1*a* and 1*b* in FIG. 3) in the strip 9 over a length at least equal to the total length of a row of containers provided with end handles. The electrodes 24A and 24B are so shaped as to form simultaneously the marginal welds of the two handles P1 and P2 as well as the three transverse welds (3*a*, 3*b* and 8 in FIG. 1) of each of the N containers in one and the same row. The tools 25A and 25B carry, respectively, punches or blades such as those shown at 22A and dies such as those shown at 16B and 22B for simultaneously cutting out the trapezoidal zones Z which separate the bottoms of contiguous containers R1 to R8 in one and the same row (FIG. 8A), for forming the notches f (FIG. 8B) which separate their pouring lips from the upper portions of the handles of contiguous containers, and, if necessary, for cuttng out the central portions of the end handles P1 and P2 of the row of containers in question.

The unit consisting of the row of containers that has just been formed is then halted below a similar number of spouts 17 for introducing a beverage (FIG. 8B), the upper edges of all of the containers in said row being held apart by the simultaneous actions of suction pads, provided in an appropriate number, only one of which, the suction pad 18A, is illustrated. When the strip 9 has advanced a further step, the row unit is halted between two pairs of resilient jaws 19A and 19B and two pairs of electrodes 21A and 21B and below a set of ten pipes 20 for the injection of compressed air, these preferably being fed by a common duct 26; the set of pipes 20 can be vertically displaced in the direction indicated by the double-headed arrow V so as to introduce the pipes into the pockets B of the various containers of the row in question, the two extreme pipes 20*a* and 20*b* being introduced into the cavities corresponding to the end pockets P1 and P2 respectively. The injection of compressed air through these pipes is of course preceded by pressing together the upper edges of all the cavities in the row by means of two resilient jaws 19A and 19B which are moved towards each other in the transverse direction D. After the set of pipes 20*a*–20*b* have been retracted and while the previously mentioned upper edges remain pressed together by the resilient jaws 19A and 19B, the cavities in the row of containers are closed by moving the welding electrodes 21A and 21B towards each other in the transverse direction D.

The construction of the container made of thin pliable synthetic material that is illustrated diagrammatically and in perspective in FIG. 9, differs from that illustrated in FIG. 1 and from that previously described mainly in that the two V-shaped folds 1*a* and 1*b* of the bottom 1 are connected to each other by adhesive at their corresponding welded ends 3*c* and 3*d*. Container, such as that illustrated in FIG. 9, or rows of ontainers, can be produced in a continuous automatic and rapid manner by the method or process illustrated in FIG. 2 by making the following modifications thereto: downstream of the supply roll b a rotatable drum 27 is mounted below the portion of the strip 9 not yet folded to the shape of a W; in the arrangement shown diagrammatically and in broken lines in FIG. 2, this drum 27 is provided on its periphery with a single tooth 27*a* which is located in an axial plane and the length 1 of which is substantially equal to 2h, h corresponding substantially to the depth of each of the two V-shaped folds 1*a* and 1*b* (see also FIG. 3). In the FIG. 9 arrangement, the folds 1*a* and 1*b* have to be connected to each other by adhesive at their welded ends (3*c* and 3*d* in FIG. 9).

Like the axis of the supply roll b, that of the drum 27 is parallel to the direction D transverse to the direction of feed F of the strip 9, and means are provided to enable the drum 27 to execute a single revolution with each feed step of the strip 9, which step is a little greater than L in FIG. 2. During this step the outermost face of the tooth 27*a* first penetrates into the upper, open, portion of the container, not illustrated, accommodating a suitable liquid or paste adhesive, said tooth face then applying some of the adhesive, carried out of said container, to a narrow transverse zone of the inner face of the strip 9, not yet folded to the shape of a letter W, this transverse face being precisely centered along the longitudinal axis of symmetry of the strip 9. The adhesive may be of the instantly drying kind, so that the two V-shaped folds formed at the middle of the strip 9, after it has been folded to the shape of a letter W, (folds 1*a* and 1*b* in FIG. 3), become connected to each other by simple pressure exerted by guide rollers 12A and 12B at distances corresponding precisely to the successive feed steps of said strip 9, and along lengths which, for each adhesive bonded zone, correspond substantially to the sum of the widths of the welds 3*a* and 3*b* (FIG. 9), plus the widths of the narrow welds between two contiguous containers in the row (this length corresponding to the width, in the circumferential direction, of the single tooth 27*a* of the drum 27). It is, of course, also possible to use, as the adhesive, a substance which bonds under heat, by means of which adhesion of the contiguous faces of the inner sides of two V-shaped folds 1*a* and 1*b* in the strip 9, folded to the shape of a letter W, results in particular from the calorific action of the vertical portions of the welding electrodes, such as those shown at 15A and 15B (FIG. 2), which are used to form the first and second transverse welds 3*a* and 3*b* respectively. In the manufacture of the container shown in FIG. 9, these last-mentioned electrodes 15A and 15B clearly have to be formed in such a way that said first and second welds 3*a* and 3*b* are not bevelled at their lower portions but extend vertically in direct extension of the median portion of the welds 3*a* and 3*b*, as indicated in broken lines in the case of the electrode 15B (FIG. 2).

The container obtained in this way, which is illustrated in FIG. 9, is likewise flattened across its bottom 1 by the weight of the mineral water contained in its main cavity A, and this increases its stability on a flat surface, the more so since the flattened portion of its bottom 1 is surrounded on all sides by a weld bead 7*a*, 7*b* which is practically continuous and of substantially rectangular form, this bead forming a kind of rigid frame which contributes to supporting the container on a flat surface.

I claim:

1. A process for the continuous manufacture of identical containers with handles in a thin and pliable composite synthetic material heat-weldable on one face only, which process consists in: advancing horizontally in a stepwise manner a strip of composite material folded longitudinally to the shape of a letter W, each feed step being a little greater than the width of each container to be produced or than a multiple of its width, and, to produce at least one container between each two successive feed steps, simultaneously welding the bottoms of the two V-shaped folds in said strip; making a first and second weld, extending transversely of said strip and separated by a distance corresponding to the required width of each container to be manufactured, and interconnecting the inner faces of said folded strip and of its two V-shaped folds; making a third weld, delimiting, together with the first weld, a main cavity in the container to be produced and, together with said second weld, delimiting a closed handle forming pocket in said container, said cavity and pocket then remaining open at the brought-together upper edges of said strip at least at said main cavity; separating said upper edges and introducing a liquid into said main cavity; injecting a gas under pressure into said pocket to provide rigidity to said container; pressing the upper edges of said folded strip against each other during injection of gas under pressure; then, after injection of said gas has been completed, welding together the upper edges of said folded strip so as to close said main cavity and said pocket, said pocket thereby forming a permanently sealed handle.

2. A process according to claim 1, wherein each first and second weld is so made as to form a bevelled corner in the area of the two V-shaped folds in the strip, the process also comprising a further stage for cutting out the two superposed substantially trapezoidal zones which are delimited, in the two V-shaped folds of said strip, by the adjoining bevelled corner welds of two adjacent containers produced one after the other.

3. A process according to claim 1 wherein prior to folding the strip to the shape of a letter W, narrow transverse layers of adhesive are applied to a median zone of said strip that is intended to form the outer faces of the adjacent elements of the two V-shaped folds, the positions of these layers corresponding to those of the first and second transverse welds which are made after the strip has been folded.

4. A process according to claim 1, wherein each finished container is separated from the strip folded to the shape of a letter W, at the narrow joint which connects it to the next manufactured container.

5. A process according to claim 1 for the continuous manufacture of rows of containers, further including the step consisting in forming in the strip folded to the shape of a letter W, at least one end handle, by welding up the periphery of each handle.

6. A process according to claim 5, wherein a rigid plate is inserted in the strip folded to the shape of a letter W, before forming each end handle.

7. A process according to claim 5, wherein the central portion of each end handle is cut away.

8. A process according to claim 5, wherein two adjacent end handles are formed in the strip folded to the shape of a letter W.

9. A process according to claim 8 wherein the two adjacent end handles are formed simultaneously between two successive steps in the advance of the folded strip.

10. A process according to claim 9, wherein the stage in which the two adjacent end handles are simultaneously formed consists in forming, by welding in the strip folded to the shape of a letter W, at least two communicating pockets which are open at their upper brought-together edges of said folded strip; injecting through the opening in said pockets a gas under pressure; pressing together the upper edges of said folded strip during injection of gas under pressure; and then, after injection of gas has been completed, closing, by welding, the openings between the two pockets as well as the gap whereby they communicate with each other.

11. A process according to claim 5, wherein the first weld for producing a first container is so made that its upper portion delimits a zone in the form of a pouring spout, which process also comprises a phase, following production of a second container immediately following said first container and consisting in forming, in the brought-together upper edges of said folded strip, a narrow notch separating said second container from said zone forming the pouring spout for said first container.

* * * * *